US005354007A

United States Patent [19]

Fissmann et al.

[11] Patent Number: 5,354,007

[45] Date of Patent: Oct. 11, 1994

[54] WEB LEADER GUIDING DEVICE UTILIZING TURBULENCE-GENERATING NOZZLES

[75] Inventors: Hans-Joachim Fissmann; Hans Weiss; Hans-Albrecht Ruff, Heidenheim, all of Fed. Rep. of Germany

[73] Assignee: J. M. Voith GmbH, Heidenheim, Fed. Rep. of Germany

[21] Appl. No.: 66,621

[22] Filed: May 24, 1993

Related U.S. Application Data

[63] Continuation of Ser. No. 714,860, Jun. 13, 1991, abandoned.

[30] Foreign Application Priority Data

Jun. 13, 1990 [DE] Fed. Rep. of Germany ..... 4018883

[51] Int. Cl.[5] ..... B65H 19/28

[52] U.S. Cl. ..... 242/532.7

[58] Field of Search ..... 242/67.1 R, 56.6, 56.2; 226/97, 195; 34/120, 156

[56] References Cited

U.S. PATENT DOCUMENTS 1,338,094 4/1920 Pope ..... 34/120 X
3,756,527 9/1973 Collins et al. ..... 242/56.6 X
3,764,085 10/1973 Hawkins ..... 242/56.6
3,873,013 3/1975 Stibbe ..... 226/97
4,501,643 2/1985 Kiuru ..... 162/286
4,923,567 5/1990 Liedes et al. ..... 226/7 X

FOREIGN PATENT DOCUMENTS 3117094 11/1982 Fed. Rep. of Germany .

*Primary Examiner*—Daniel P. Stodola
*Attorney, Agent, or Firm*—Baker & Daniels

[57] ABSTRACT

A device for feeding the leader of a paper web from below to a rolling machine roll, with a number of guide plates which direct the web leader upward and which, viewed in the web running direction, are arranged increasingly more steeply and eventually vertically, additionally with blowing organs that feature each a hollow body arranged transverse to the web running direction and a number of nozzles arranged in the web running direction, and which, viewed in web running direction, are arranged each between two overlapping guide plates. The invention is characterized in that at least the blowing organ which, in the web running direction, precedes the first vertical plate features turbulence-generating nozzles.

15 Claims, 3 Drawing Sheets

WEB LEADER GUIDING DEVICE UTILIZING TURBULENCE-GENERATING NOZZLES

This is a continuation of application Ser. No. 07/714,860, filed Jun. 13, 1991, now abandoned.

BACKGROUND OF THE INVENTION

The invention concerns a device for feeding the leader of a paper web from below to a rolling machine roll, with a number of guide plates feeding the web leader upward. Viewed in the running direction of the web, the guide plates are arranged increasingly steep, and eventually vertically. Blowing organs, each of which features a hollow body arranged transverse to the running direction of the web, and a number of nozzles arranged in the running direction of the web, are featured. The blowing organs are each arranged between two guide plates. Such a device is known from DE 38 20 846.

On rolling machines with web feeding from below, threading a new paper web is time-consuming. To achieve optimum conditions, all possible operating parameters are adjustable, for instance the inclination of the guide plates, position and direction of the blowing organs, and so forth. A design of this arrangement has thus far not been mastered so that a satisfactory web handling will result. If with the prior devices air is supplied at excess velocity and in excess quantities, the web will flutter and its run will be uncontrollable. If the speed or quantity or both are too low, the web will not be positively fed upward.

On devices according to the cited DE 38 20 846, attempts have been made at preventing the flutter by laminary sparing along the surface of the individual guide plates. However, this results frequently in a sticking of the web to the guide plate.

The devices according to DE 31 02 894 and DE 31 17 094 have not been satisfactory.

The problem underlying the invention is to provide a device safeguarding a positive upward feeding of the device, with low mechanical expense and little adjustment expense of the individual parameters responsible for the aerodynamics of the blowing air.

SUMMARY OF THE INVENTION

This problem is solved by the features of the present invention. In the present invention, a particular blowing organ preceding a guide plate, in particular the first vertical plate in the running direction of the web, features turbulence-generating nozzles. As a result, a safe contact of the web leader with the respective roll of the rolling machine is achieved. In general, suction can be applied on that roll.

The entire blowing air handling is designed in an extremely simple manner. The blowing nozzles are mostly round bores or slots, at any rate not flat jet nozzles that achieve a laminary air flow. The blowing effect of the nozzles is extremely effective. Due to the design of the invention, the paper web floats on an air cushion contained between the paper web and guide plates. A sticking of the paper web to the guide plate is safely avoided.

DESCRIPTION OF THE PREFERRED EMBODIMENT

Figure 1:
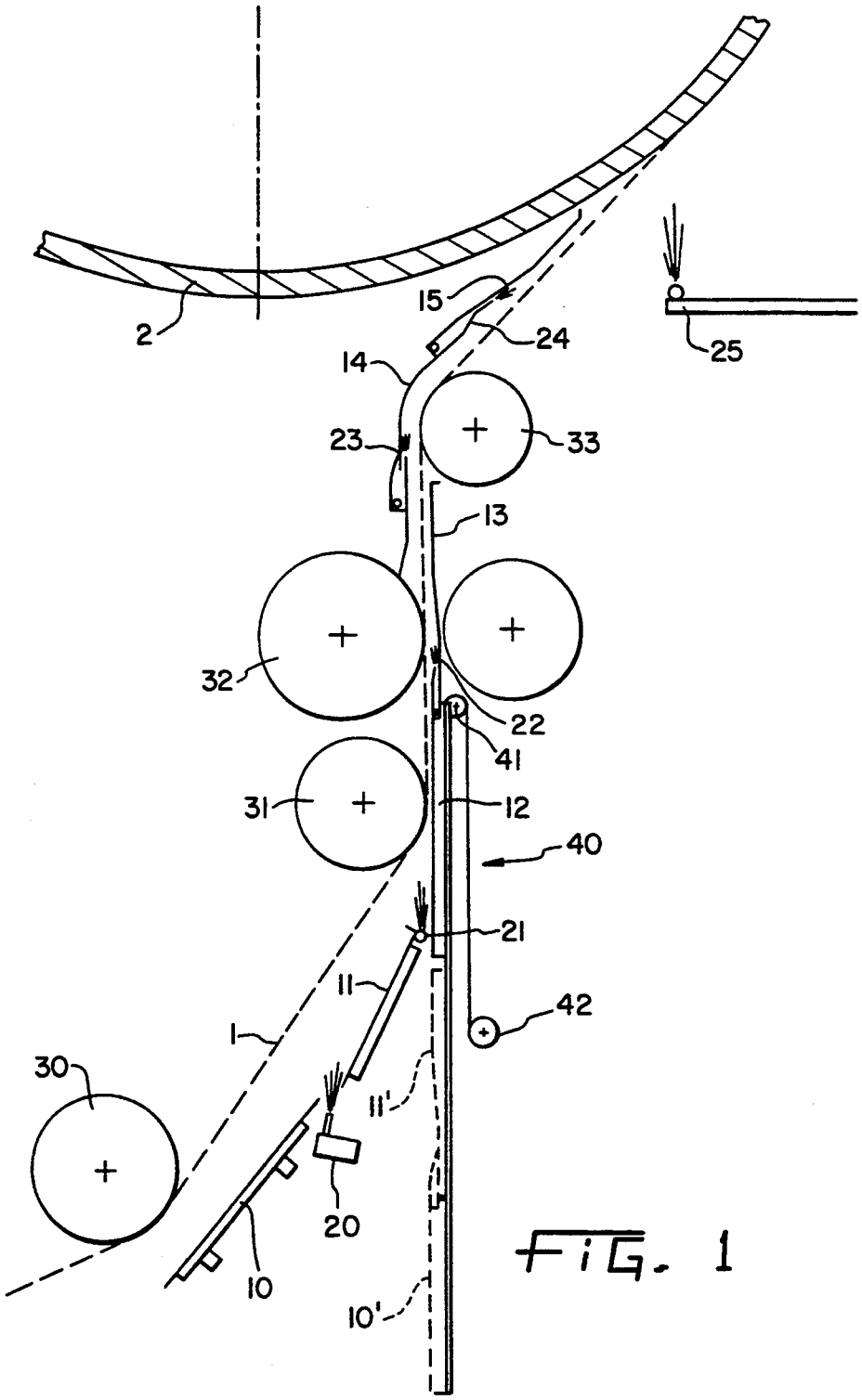
FIG. 1 shows a device for feeding the leader of a paper roll of a rolling machine.

FIG. 1 represents a device for feeding the leader of a paper web 1 to the roll 2 of a rolling machine. The device comprises a series of guide plates 10, 11, 12, 13, 14 and 15. These are arranged in such a way that between adjacent plates there remains a slot type opening extending transverse to the running direction of the paper web 1. Blowing organs 20, 21, 22, 23, 24 are arranged in the area of these openings. Each blowing organ features a hollow body arranged transverse to the running direction of the web, which hollow body consists of a blowing chamber. These organs feature blowing nozzles whose discharge openings act more or less in the running direction of the web. The nozzles consist of slots that extend vertically or parallel to the running direction of the web and have a length of 0.2 to 2 mm, preferably 0.5 mm. The nozzles are so designed and arranged that the air flow generated by them is predominantly turbulent.

Slot type openings having width of between 1 and 20 mm, preferably 5 mm, are provided between adjacent blowing nozzles. The guide plates 10 and 11 are tilted relative to the vertical, with plate 11 being arranged steeper than the plate 10. Lastly, plates 12 and 13 are arranged vertically. The plate 14 is curved and results thus in a reversal of the web 1. The plate 15, finally, is tilted and extends essentially tangentially to the shell surface of the roll 2.

As an alternative to plates 10 and 11, plates 10' and 11' may be arranged to feed the web upward in a different way. Thus, the first two plates need not be inclined, but may extend vertically right away.

Figure 2:
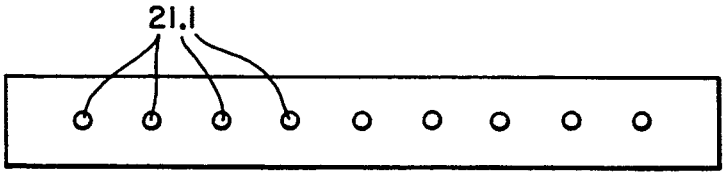
FIG. 2 shows one embodiment of blow pipe 21, having bores.
Figure 3:
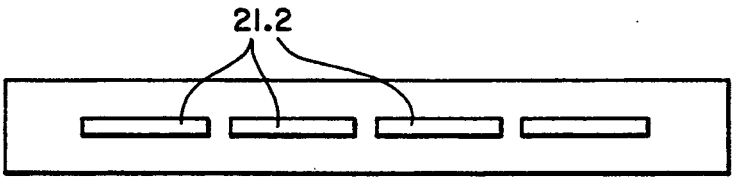
FIG. 3 shows another embodiment of flow pipe 21 having slots.

Although presently all of the blowing organs are equipped with blowing nozzles generating turbulence, this need not be the case. It is important, however, that the blowing nozzle 21 is a nozzle that generates turbulence. Two embodiments of blow pipe 21 are shown in FIGS. 2 and 3. FIG. 2 shows bores 21.1, while FIG. 3 shows slots 21.2. Presently, in the design with the plates 10 and 11, this nozzle is contained at the transition between the last inclined plate and the first vertical plate. If all of the guide plates are arranged only vertically, this blowing organ with the turbulence-generating blowing nozzles should be arranged not too close to the beginning of the entire feed section.

The slot type openings are interrupted between two adjacent blowing nozzles. The length of said slots amounts to between 50 and 150 mm, preferably 50 mm. The slot type openings do not extend continuously in the crosswise direction, but are divided in a number of slots of smaller lengths, so that between neighbored slots a certain land area exists.

The ratio of the opening surface of the nozzles to the cross-sectional area of the blowing chambers is 1:1 to 1:3, preferably 1:2. In the embodiment shown in the drawing, plate 11 is inclined against the vertical plane under an angle of, for example, 30 degrees, whereas plate 12 is fully vertical. The direction of the jet of air, on the one hand, is not the same as is the direction of plate 11, and on the other hand, is not vertical so that it is not identical with the direction of plate 12. In the particular case, the jet of air is directed at an angle which is about one-half or less, of the angle which plate 11 forms with plate 12. The angle between the air jet emitting from blowing organ 21 and the first vertically arranged guide plate 12 is 0°–15°, preferably 10°. The air jet that is directed in this manner will prevent the sheet from closely sticking to the surface of plate 12.

As can be seen, the web is additionally carried by a number of guide rolls 30, 31, 33. Two circular blades 32 are provided, one of which serves as backing blade. A longitudinal cut can be placed through the paper web with these two circular blades.

An additional blowing organ 25 in the end area of the feed section serves to fix the paper web on the shell surface of roll 2.

Figure 4:
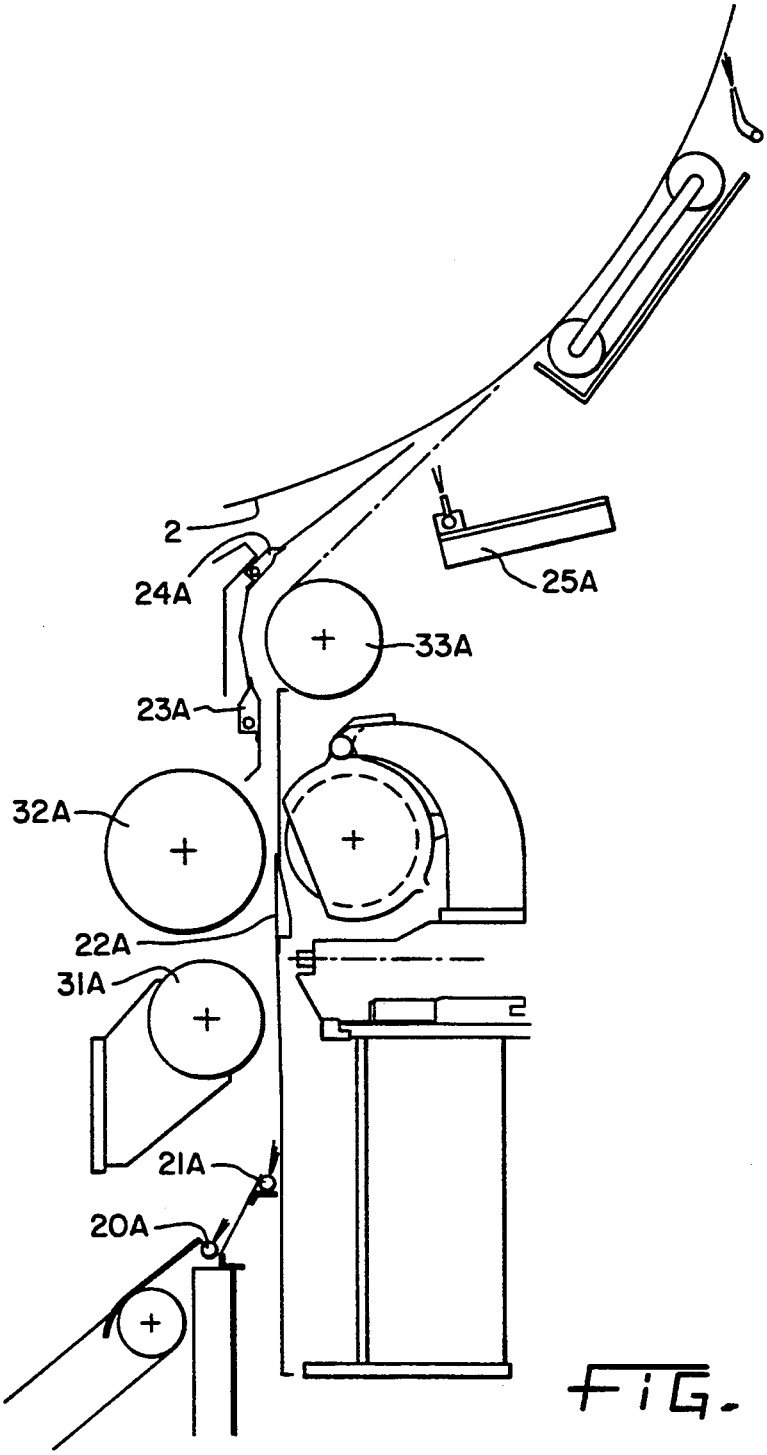
FIG. 4 shows a side elevational view of a device for feeding the leader of a paper roll of a rolling machine.
Figure 5:
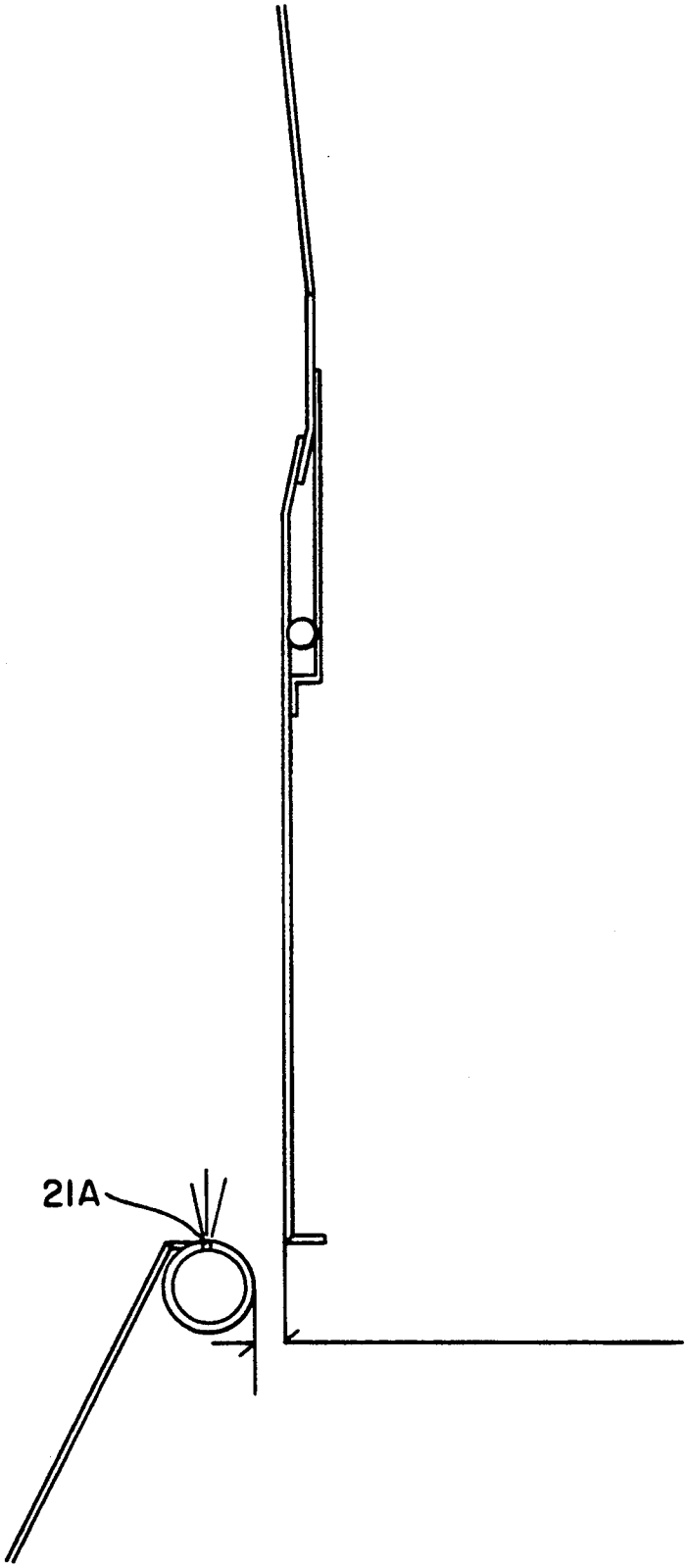
FIG. 5 shows an enlarged view of a portion of the device of FIG. 4.

The blowing nozzles are preferably formed of regular bores. Preferably, these have a mutual spacing of 1 to 20 cm, most preferably 10 cm. The bores have a diameter of 1 to 5 mm, preferably 1.5 mm. FIG. 4 shows a side elevational view of an embodiment of a device according to the present invention. FIG. 5 shows a portion of the device of FIG. 4 shown on an enlarged scale. In this embodiment, the lower blow pipe 21A has a plurality of bores of 1.5 mm diameter. Preferably, the bores are arranged longitudinally along the length of the pipe at a distance of 100 mm between two neighbored bores. There is a slot width of 0.5 mm formed between two plates, which slot extends over the working width of the machine.

A cable pull 40 with guide rolls 41, 42 serves to raise and lower the feeding device.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A device for feeding the leader of a running web upwardly to a rolling machine roll from a position originating below said machine roll, comprising:

a plurality of successively arranged guide plates for guiding said web leader in said upward direction toward said machine roll, said guide plates being positioned so that successive guide plates beginning with the lowermost of said guide plates are tilted at increasingly steep angles until a guide plate is positioned vertically, successive guide plates positioned relative to one another to define a slot opening between adjacent guide plates; and a plurality of blowing organs, each of said blowing organs having a hollow body arranged transverse to the web running direction and having a plurality of bores arranged longitudinally along said hollow body, each of said blowing organs being arranged in a respective slot opening, wherein turbulent air flow is generated by the bores of the blowing organ immediately preceding said vertically positioned guide plate from below; said device further being structured and arranged so that an opening is disposed between said blowing organ immediately preceding said vertically positioned guide plate from below and said vertically positioned guide plate.

2. The device of claim 1, wherein each of said slot openings defined by said successive guide plates has a width between 1 and 20 mm.

3. The device of claim 1, wherein each of said slot openings defined by said successive guide plates has a width of 5 mm.

4. The device of claim 1, in which said web leader meets said machine roll at an end area, wherein a blowing organ is provided in said end area for laying said web leader on the roll.

5. The device of claim 1, in which said blowing organ immediately preceding said vertically positioned guide plate from below emits an air jet, wherein the angle between said air jet and said vertically positioned guide plate is 0°–15°.

6. The device of claim 1, in which said blowing organ immediately preceding said vertically positioned guide plate from below emits an air jet, wherein the angle between said air jet and said vertically positioned guide plate is 10°.

7. A device for feeding the leader of a running web upwardly to a rolling machine roll from a position originating below said machine roll, comprising:

a plurality of successively arranged guide plates for guiding said web leader in said upward direction toward said machine roll, said guide plates being positioned so that successive guide plates beginning with the lowermost of said guide plates are tilted at increasingly steep angles until a guide plate is positioned vertically, successive guide plates positioned relative to one another to define a slot opening between adjacent guide plates; and a plurality of blowing organs, each of said blowing organs having a hollow body arranged transverse to the web running direction and having a plurality of slots arranged longitudinally along said hollow body, each of said blowing organs being arranged in a respective slot opening, wherein turbulent air flow is generated by the slots of the blowing organ immediately preceding said vertically positioned guide plate from below; said device further being structured and arranged so that an opening is disposed between said blowing organ immediately preceding said vertically positioned guide plate from below and said vertically positioned guide plate.

8. The device of claim 7, wherein each of said slot openings defined by said successive guide plates has a width between 1 and 20 mm.

9. The device of claim 8, wherein said openings defined by said adjacent guide plates have a width of 5 mm.

10. The device of claim 7, in which each of said hollow bodies consists of a blowing chamber, and wherein said slots have a length of 0.2 to 2 mm.

11. The device of claim 10, wherein said slots have a length of 0.5 mm.

12. The device of claim 7, in which said web leader meets said machine roll at an end area wherein a blowing organ is provided in said end area for laying said web leader on the roll.

13. The device of claim 7, in which said blowing organ immediately preceding said vertically positioned guide plate from below emits an air jet, wherein the angle between said air jet and said vertically positioned guide plate is between 0° and 15°.

14. The device of claim 13, wherein said angle is 10°.

15. A device for feeding the leader of a running web upwardly to a rolling machine roll from a position originating below said machine roll, comprising:

a plurality of successively arranged guide plates for guiding said web leader in said upward direction toward said machine roll, said guide plates being positioned so that successive guide plates beginning with the lowermost of said guide plates are tilted at increasingly steep angles until a guide plate is positioned vertically, successive guide plates positioned relative to each other to define a slot opening between adjacent guide plates;

a plurality of blowing organs, each of said blowing organs having a hollow body arranged transverse to the web running direction and having a plurality or bores arranged longitudinally along said hollow body, each of said blowing organs being arranged in a respective slot opening, wherein turbulent air flow is generated by the bore of the blowing organ immediately preceding said vertically positioned guide plate from below;

the downward portion of said vertical guide plate as viewed in the direction of travel of the web, and the upstream portion of the immediately following plate being positioned relative to one another thereby forming a blowing chamber, and further comprising a slot like exit for compressed air so as to produce an air curtain between the web and the said following plate.

* * * * *

UNITED STATES PATENT AND TRADEMARK OFFICE

CERTIFICATE OF CORRECTION

PATENT NO. : 5,354,007

DATED : October 11, 1994

INVENTOR(S) : Hans-Joachim Fissmann et al.

It is certified that error appears in the above-identified patent and that said Letters Patent is hereby corrected as shown below:

In the Abstract of the Disclosure, line 10, after "two", delete "overlapping".

Signed and Sealed this

Thirteenth Day of December, 1994

*Attest:*

Bruce Lehman

BRUCE LEHMAN

*Attesting Officer*

*Commissioner of Patents and Trademarks*